US007547136B2

(12) United States Patent
Bravo et al.

(10) Patent No.: US 7,547,136 B2
(45) Date of Patent: Jun. 16, 2009

(54) OSCILLATING WEIGHT FOR RECHARGING THE ENERGY SOURCE OF A PORTABLE INSTRUMENT

(75) Inventors: Paulo Bravo, Hauterive (CH); Nicolas Ehrsam, Evilard (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 11/932,421

(22) Filed: Oct. 31, 2007

(65) Prior Publication Data

US 2008/0101163 A1 May 1, 2008

(30) Foreign Application Priority Data

Oct. 31, 2006 (EP) ..... 06022676

(51) Int. Cl.
*G04B 3/00* (2006.01)
*G04B 1/00* (2006.01)
*G04B 5/02* (2006.01)

(52) U.S. Cl. ..... 368/152; 368/203; 368/208; 310/36

(58) Field of Classification Search ..... 368/139, 368/145–152, 206–210; 310/36, 37, 40 R, 310/75 R, 75 A, 80
See application file for complete search history.

(56) References Cited

U.S. PATENT DOCUMENTS

| | | | | |
|---|---|---|---|---|
| 2,610,462 | A * | 9/1952 | Huguenin | 368/208 |
| 3,628,326 | A * | 12/1971 | Polo | 368/208 |
| 6,021,098 | A * | 2/2000 | Rebeaud | 368/204 |
| 7,217,030 | B2 * | 5/2007 | Papi | 368/150 |
| 2004/0222637 | A1 * | 11/2004 | Bednyak | 290/1 R |

FOREIGN PATENT DOCUMENTS

| | | |
|---|---|---|
| CH | 142511 | 12/1930 |
| CH | 149136 | 11/1931 |
| CH | 317534 | 1/1957 |
| FR | 704910 | 1/1930 |

OTHER PUBLICATIONS

European Search Report issued in corresponding application No. EP 06 02 2676, completed Jul. 12, 2007.

* cited by examiner

*Primary Examiner*—Vit W Miska
(74) *Attorney, Agent, or Firm*—Griffin & Szipl, P.C.

(57) ABSTRACT

The oscillating weight includes a primary oscillating weight (10) secured to a drive arbor (6) and at least one secondary oscillating weight (20), which is mobile relative to the primary weight to cause the initial impulse. The secondary weight (20) is formed by a part assembled to the primary weight (10) from the exterior, while being able to have a travel between two stop members (12*a*, 12*b*) of a guide means (14, 18) located on the periphery of the primary weight (10).

20 Claims, 4 Drawing Sheets

Fig. 4
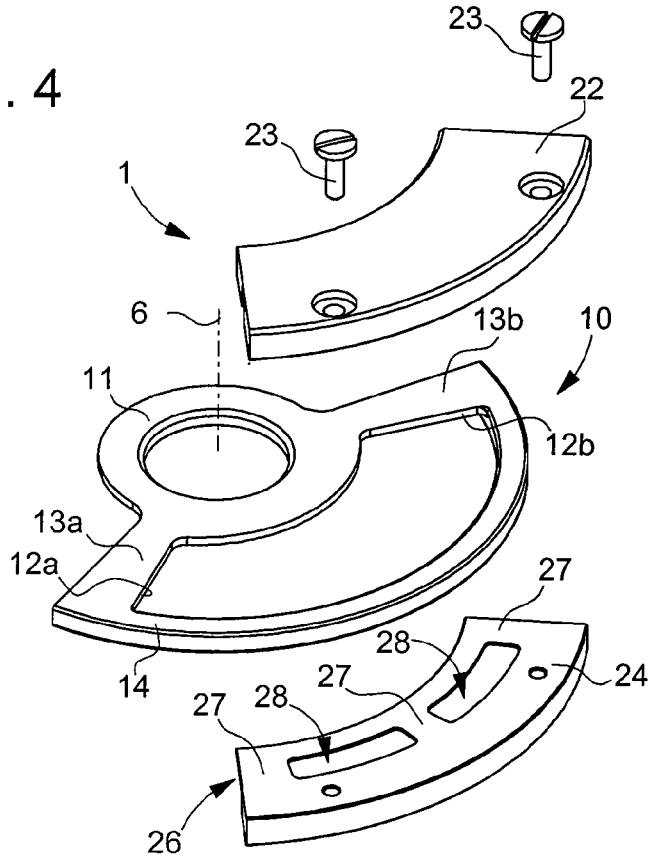
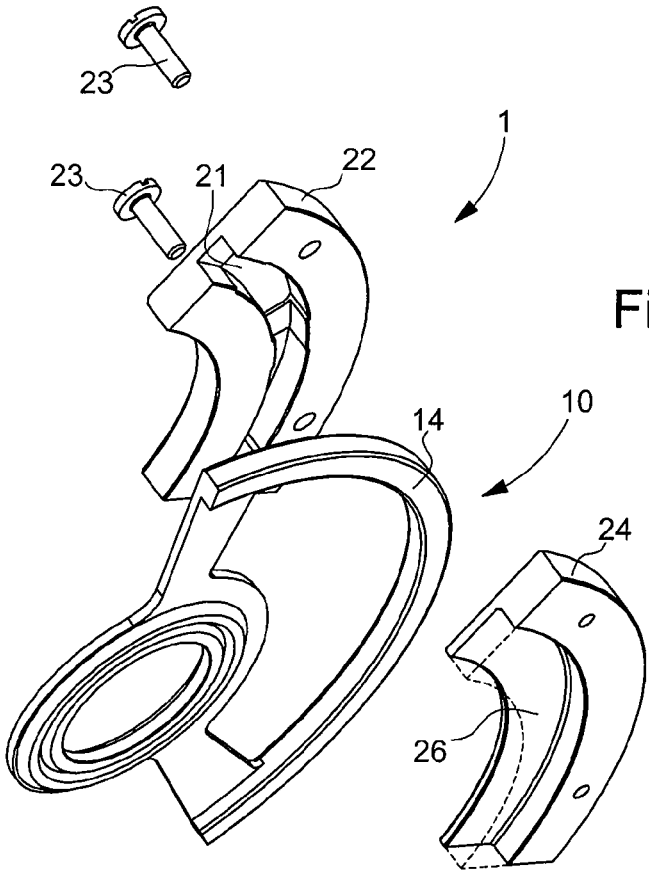
Fig. 5

OSCILLATING WEIGHT FOR RECHARGING THE ENERGY SOURCE OF A PORTABLE INSTRUMENT

This application claims priority from European Patent Application No. 06022676.8 filed Oct. 31, 2006 of which is incorporated herein by reference.

FIELD OF THE INVENTION

The present invention concerns an oscillating weight for a portable instrument whose movements in use set said oscillating weight in motion to drive, either an automatic winding device, for example that of a barrel spring of a timepiece movement, which will be taken by way of example below, or a generator able to recharge an electric energy source of any other portable instrument.

BACKGROUND OF THE INVENTION

In mechanical watches, for a long time devices have been proposed that avoid manual winding of the barrel spring owing to the movements of the wearer. CH Patent No. 142 511, published in 1930, is very representative of the solutions that were already proposed at that time using an oscillating weight, with simple or dual action, whose pinion drives a reducer kinematic chain which will rewind the spring.

Numerous improvements have been made to this principle as regards the shape, the nature or placing of the weights, and their point of pivoting.

It was also very quickly realised that the efficiency of an oscillating weight for automatic winding depends on the extent of activity of the wearer, but also and perhaps more importantly, on the initial impulse that it was given, for the balance movement to be able to be maintained thereafter by the ordinary movements of the wearer.

In order to create this initial impulse, without imposing excessive agitation of the wearer, various solutions have already been proposed.

CH Patent No. 317 534 discloses a device wherein a semi-circular pendular element pivots between two plates of the main oscillating weight in order to create the initial impulse. In CH Patent No. 149 136, the initial impulse is provided by a moving load (mercury, steel ball, etc. . . . ) arranged in a housing formed inside the main oscillating weight.

These constructions are relatively complicated and cumbersome, and have never, to the knowledge of the Applicant, been integrated into a timepiece movement released on the market.

SUMMARY OF THE INVENTION

It is thus an object of the present invention to overcome the drawbacks of the aforecited prior art by providing an oscillating weight including a primary weight and a secondary weight for giving the initial impulse, of simple and economical structure and possibly adaptable with few alterations to an existing oscillating weight made in a single piece.

The invention therefore concerns an oscillating weight, devised for causing an initial impulse, subsequently maintained by the natural movements of the wearer, while being of relatively simple and economical structure. It includes a primary oscillating weight secured to an arbour driving a kinematic chain and at least one secondary weight mobile relative to the primary weight for giving the initial impulse to the primary weight by shocks. The invention is characterized in that the secondary weight forms a part assembled from the exterior to the primary weight while being able to have a travel that generates shocks on stop members arranged at the ends of guide means located at the periphery of said primary weight. The following detailed description will give, by way of example, various embodiments that all rely on the same inventive concept.

BRIEF DESCRIPTION OF THE DRAWINGS

Other features and advantages of the present invention will appear in the following description of various embodiments, given by way of non-limiting illustration with reference to the annexed drawings, in which:

FIG. 4 is an exploded perspective diagram of the first embodiment viewed from above;

FIG. 5 corresponds to FIG. 4 in a bottom view;

DETAILED DESCRIPTION OF ONE EMBODIMENT

Figure 1:
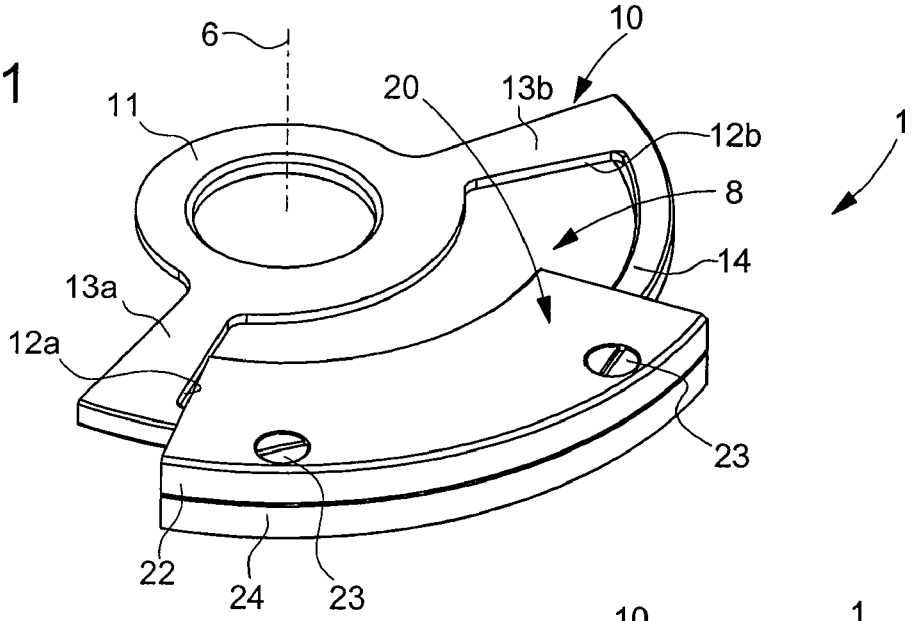
FIGS. 1, 2 and 3 show in perspective a first embodiment in three positions.

Referring first of all to FIGS. 1 to 5 a first embodiment of an oscillating weight according to the invention will be described hereinafter. FIG. 1 shows the oscillating weight at rest, i.e. when the user of a wristwatch fitted with such an oscillating weight is not making any movement, or he has removed it from his wrist. It comprises two parts 10 and 20 that can move relative to each other. A first part, which will be designated the "primary mass" 10 hereinafter, is secured to the drive arbour 6 (represented only by the line of its axis) which includes in a known manner a pinion meshing with a kinematic chain to rewind a barrel spring or to drive a generator to recharge a battery.

Primary weight 10 is formed of an armature in a single piece including a securing ring 11 on arbour 6, and two arms 13*a*, 13*b* whose ends are joined by a felloe 14. The central part of primary weight 10 includes a recess 8 in the form of an annular sector which will allow the displacement of secondary weight 20.

Referring also to FIGS. 4 and 5, it can be seen that secondary weight 20 is made of two elements, a top element 22 and bottom element 24, assembled from the exterior on either side of felloe 14 by means of screws 23 or by any other equivalent securing means.

As can be seen more easily in FIG. 5, a groove 21 is formed in the base of top element 22 to match the shape of felloe 14. FIG. 5 also shows that bottom element 24 includes a thinned part 26 whose only function is to leave a little more space for the subjacent moving parts. It will also be observed that groove 21 could equally be formed in bottom element 24, if the latter had the "solid" shape shown in dotted lines.

It can also be seen that bottom element 24 includes apertures 28 arranged by felloe 14, separated therefrom by full or solid zones 27, which reduces the friction surface with said felloe 14. These full zones 27 and the surfaces of felloe 14 could also have a deposition or coating for improving tribological properties, such as a film of oil or grease, a molybdenum sulphide, DLC (diamond like carbon) or suchlike.

Figure 2:
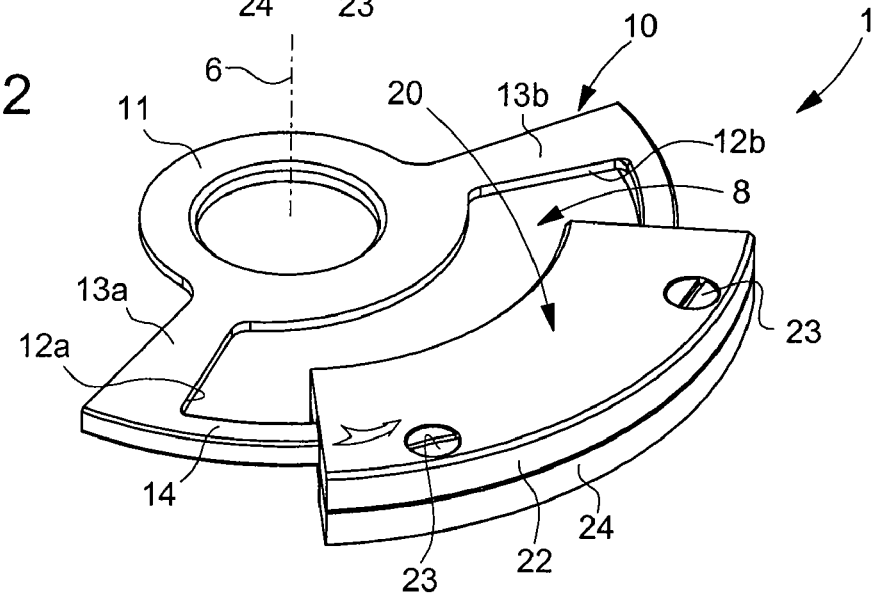

FIG. 2 shows the displacement of secondary weight 20, even when the wearer makes a movement of small amplitude.

Figure 3:
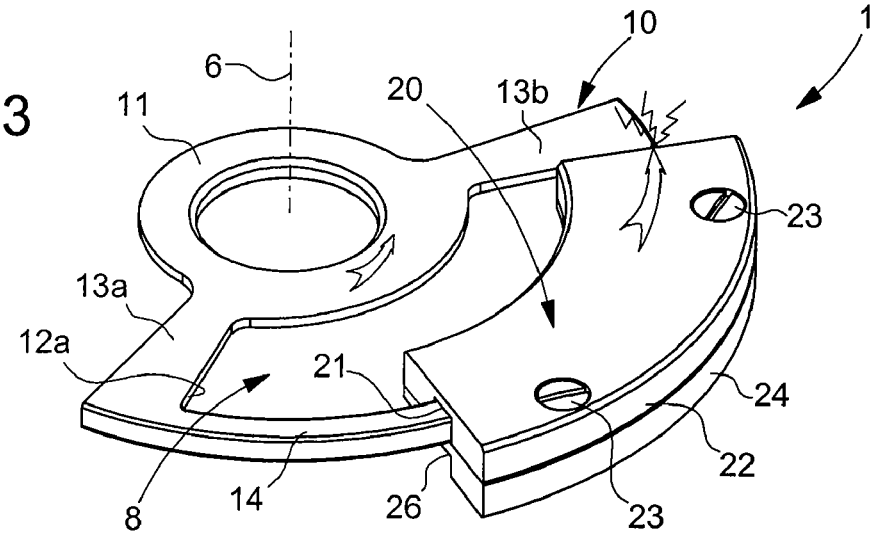

FIG. 3, shows the shock produced at the end of travel of secondary weight 20, which will set primary weight 10 in motion.

Figure 6:
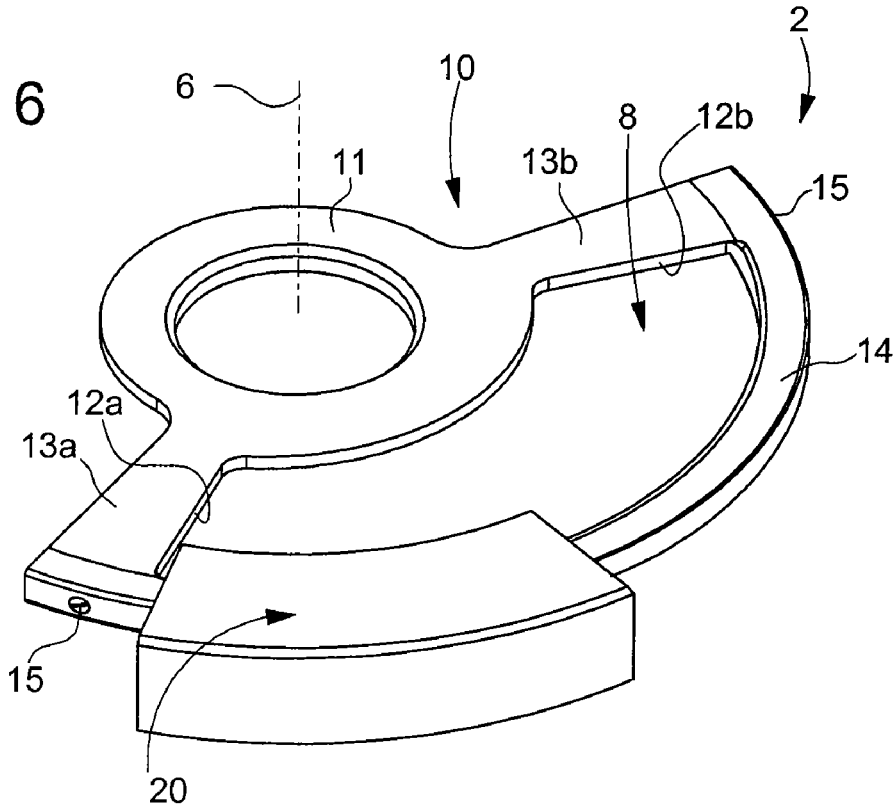
FIGS. 6, 7, 8 and 12 correspond to four other embodiments.

FIG. 6, shows a second embodiment which differs from the preceding one in that primary weight 10 is made with a separable felloe 14, and in that secondary weight 20 is made in a single piece with a circular path corresponding to groove 21 of the first embodiment. Secondary weight 20 may also be formed of two pre-assembled elements, for example by welding. This secondary weight 20 is fitted onto felloe 14, which is then fixed to the ends of arms 13*a*, 13*b* by means of screws 15, or by any other equivalent means.

Figure 7:
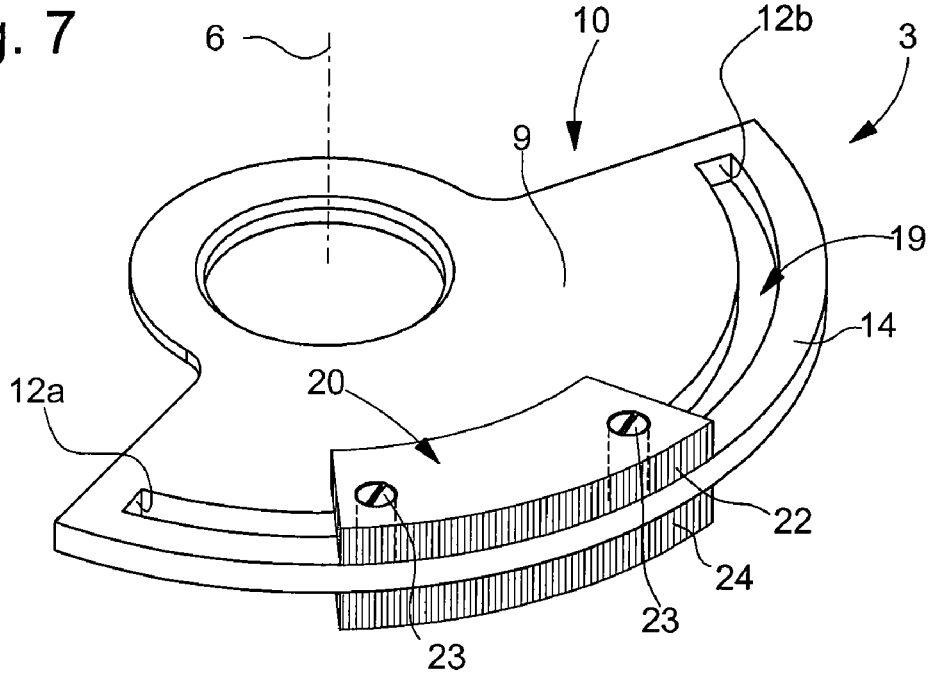

FIG. 7 shows a third embodiment wherein primary weight 10 is made in a single piece and includes a circular sector 9 in which a slot 19 is formed, which acts as guide means for secondary weight 20. Secondary weight 20 is then made in two parts 22, 24 which are assembled by means of two screws 23 whose rods pass through slot 19. Circular sector 9 is shown as being solid, but it could also have an annular recess 8, as in the first embodiment.

Figure 8:
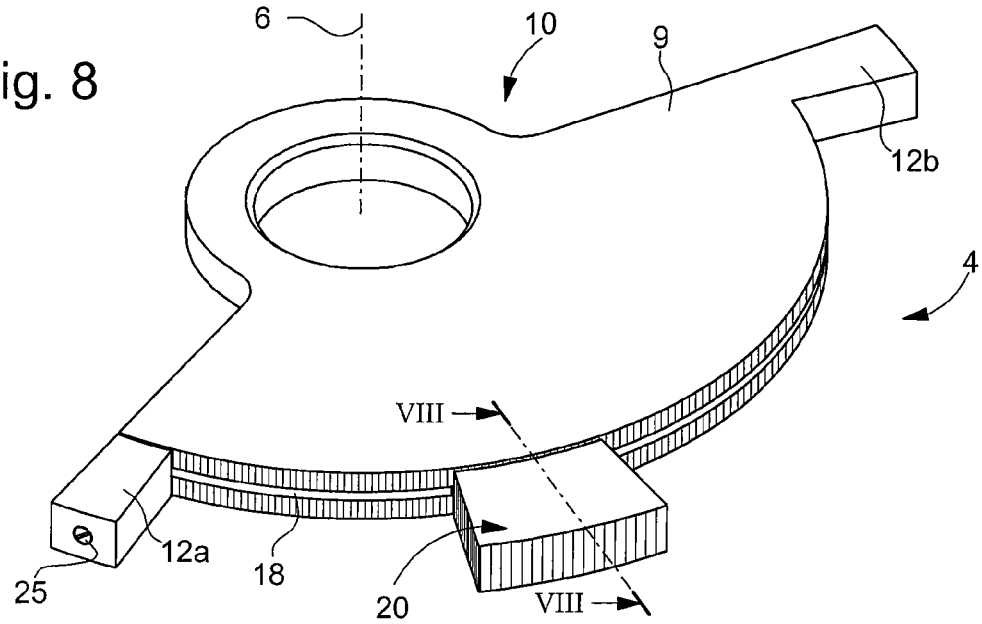
Figure 9:
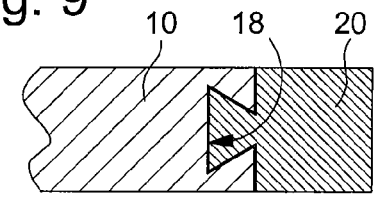
FIGS. 9, 10 and 11 show a cross-section along line VIII-VIII of FIG. 8 variants of the connection between the primary weight and the secondary weight.

FIG. 8 shows a fourth embodiment wherein secondary weight 20 is guided by a recess 18 formed in the thickness of primary weight 10. Recess 18 and one part of secondary weight 20 slide into each other by means of a "dovetail" type assembly, the female part being formed by recess 18 as shown in FIG. 9. Primary weight 10 includes a stop member 12*a*, 12*b* at each end of sector 9, one of these stop members 12*a* being secured by a screw 25. This allows secondary weight 20 to slide into recess 18, then to limit the travel thereof by adjusting stop member 12*a*. It can be seen that this is a particularly simple construction.

Figure 11:
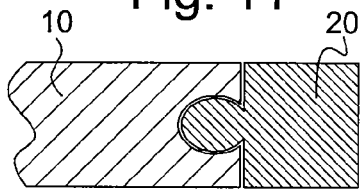
Figure 10:
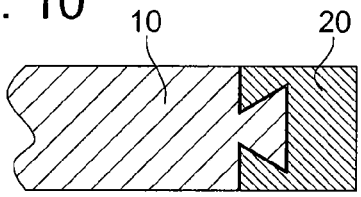

This dovetail assembly could also be achieved by inverting the male and female parts, as shown in FIG. 10. The shape of the male and female parts could also be different from trapezoidal, for example an open circular shape as shown in FIG. 11.

Figure 12:
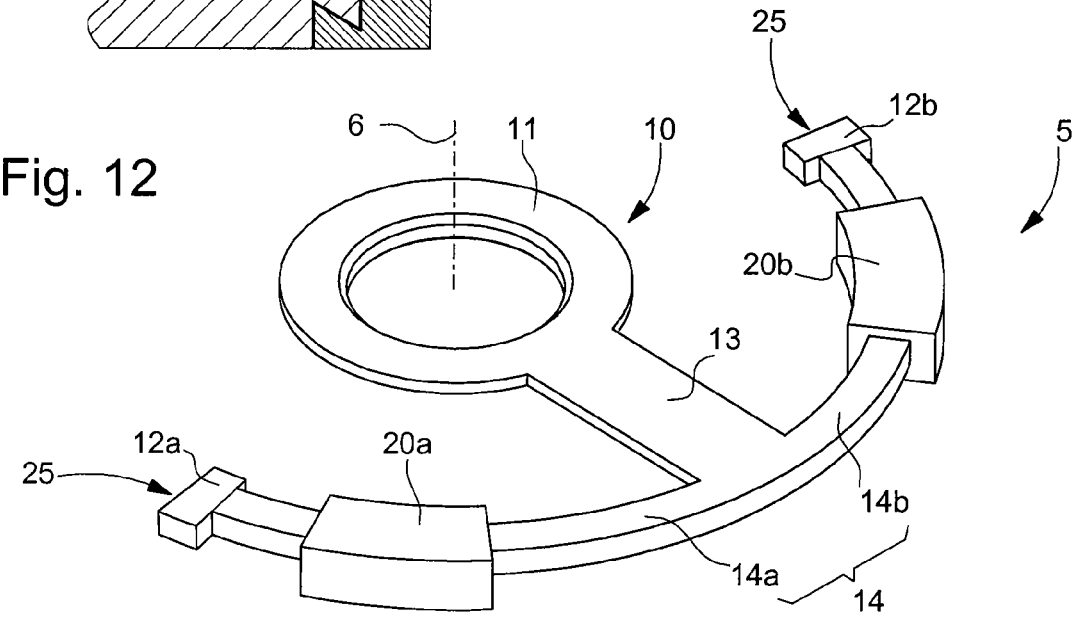

FIG. 12 shows a fifth embodiment which differs from the preceding embodiments essentially in that the secondary weight is formed of two totally independent weights 20*a*, 20*b*. Primary weight 10 is made up of an armature formed by a ring 11 for securing to the drive arbour 6, said ring being extended by a single 13 joining the median part of a felloe 14 made in two parts 14*a*, 14*b*. Each part 14*a*, 14*b* forms guide means for secondary weights 20*a*, 20*b* which are mounted so as to slide thereon. The travel of secondary weights 20*a*, 20*b* is limited by stop members 12*a*, 12*b* held in the ends of semi-felloes 14*a*, 14*b* by screws 25.

Those skilled in the art could envisage other variants without departing from the scope of the present invention, already illustrated by several embodiments.

As a variant, primary weight 10 and secondary 20 have advantageously substantially the same weight.

What is claimed is:

1. An oscillating weight mechanism having an axis of rotation, mounted on a drive arbour for automatic winding of a spring or for driving a generator, the mechanism comprising:

(a) primary oscillating weight secured to the drive arbour; and (b) at least one secondary oscillating weight that is mobile relative to the primary weight to give initial impulse to the oscillating weight mechanism;

wherein the secondary weight is formed by a part exterior to the primary weight and is able to travel along a path concentric to the axis of rotation of the oscillating weight mechanism and between two stop members attached to a guide means, wherein the guide means is located on a periphery of the primary weight and is attached thereto, wherein the primary weight comprises an armature formed by a ring for securing to the drive arbor, and two radial arms extending to a felloe, wherein the felloe forms the guide means for the secondary weight, wherein the secondary weight comprises two elements disposed on either side of the felloe, and wherein ends of the radial arms form the stop members.

2. The oscillating weight according to claim 1, wherein the primary weight and the secondary weight have substantially the same weight.

3. An oscillating weight mechanism having an axis of rotation, mounted on a drive arbour for automatic winding of a spring or for driving a generator, the mechanism comprising:

(a) a primary oscillating weight secured to the drive arbour; and (b) at least one secondary oscillating weight that is mobile relative to the primary weight to give an initial impulse to the oscillating weight mechanism;

wherein the secondary weight is formed by a part exterior to the primary weight and is able to travel along a path concentric to the axis of rotation of the oscillating weight mechanism and between two stop members attached to a guide means, wherein the guide means is located on a periphery of the primary weight and is attached thereto, and wherein the primary weight is made in two parts formed on the one hand by a ring for securing to the drive arbour extended radially by two arms, and on the other hand by a felloe secured to the ends of the arms after the secondary weight has been assembled on the felloe, made in as single part, or pre-assembled prior to mounting, so as to slide on the felloe.

4. The oscillating weight mechanism according to claim 3, wherein the primary weight and the secondary weight have substantially the same weight.

5. An oscillating weight mechanism mounted on a drive arbor for the automatic winding of a spring or for driving a generator, the mechanism comprising:

a primary oscillating weight secured to the drive arbor; and at least one secondary oscillating weight that is mobile relative to the primary weight to give an initial impulse to the oscillating weight mechanism;

wherein the secondary weight is formed by a part exterior to the primary weight and is able to travel between two stop members of guide means located on a periphery of the primary weight, and wherein the primary weight has a shape of a circular sector provided with a slot at the periphery thereof to form the guide means for the secondary weight made in two parts assembled on either side of the primary weight, by screws passing through the slot.

6. The oscillating weight mechanism according to claim 5, wherein the primary weight and the secondary weight have substantially the same weight.

7. An oscillating weight mechanism having an axis of rotation, mounted on a drive arbour for automatic winding of a spring or for driving a generator, the mechanism comprising:

(a) a primary oscillating weight secured to the drive arbour; and (b) at least one secondary oscillating weight that is mobile relative to the primary weight to give an initial impulse to the oscillating weight mechanism;

wherein the secondary weight is formed by a part exterior to the primary weight and is able to travel along a path concentric to the axis of rotation of the oscillating weight mechanism and between two stop members attached to a guide means, wherein the guide means is located on a periphery of the primary weight and is attached thereto, wherein the guide means for the secondary weight are formed by a recess formed in the thickness of the periphery of the primary weight by cooperation of complementary male and female profiles, and wherein the guide means includes a stop member at each end, at least one stop member being removably mounted by means of a screw to allow the secondary weight to engage in the recess of the primary weight.

8. The oscillating weight mechanism according to claim 7, wherein the primary weight and the secondary weight have substantially the same weight.

9. An oscillating weight mechanism having an axis of rotation, mounted on a drive arbour for automatic winding of a spring or for driving a generator, the mechanism comprising:

(a) a primary oscillating weight secured to the drive arbour; and (b) at least one secondary oscillating weight that is mobile relative to the primary weight to give an initial impulse to the oscillating weight mechanism;

wherein the secondary weight is formed by a part exterior to the primary weight and is able to travel along a path concentric to the axis of rotation of the oscillating weight mechanism and between two stop members attached to a guide means, wherein the guide means is located on a periphery of the primary weight and is attached thereto, and wherein the primary weight is made up of an armature formed by a securing ring on the drive arbour, extended radially by an arm joining a median part of a felloe whose two parts form guide means for two secondary weights, a stop member being secured to each end of the felloe after the secondary weights have been assembled.

10. The oscillating weight mechanism according to claim 9, wherein the primary weight and the secondary weight have substantially the same weight.

11. A wristwatch whose electrical or mechanical power source for the watch movement is driven by an oscillating weight mechanism having an axis of rotation, mounted on a drive arbour for the automatic winding of a spring or for driving a generator, the mechanism comprising:

(a) a primary oscillating weight secured to the drive arbour; and (b) at least one secondary oscillating weight, which is mobile relative to the primary weight to give an initial impulse to the oscillating weight mechanism;

wherein the secondary weight is formed by a part exterior to the primary weight and is able to travel along a path concentric to the axis of rotation of the oscillating weight and between two stop members attached to the guide means, wherein the guide means is located on the periphery of the primary weight and attached thereto, and wherein the primary weight comprises an armature formed by a ring for securing to the drive arbour, and to radial arms extending to a felloe, wherein the felloe forms the guide means for the secondary weight, wherein the secondary weight comprises two elements disposed on either side of the felloe, and wherein the ends of the radial arms form the stop members.

12. The oscillating weight mechanism according to claim 11, wherein the primary weight and the secondary weight have substantially the same weight.

13. A wristwatch whose electrical or mechanical power source for the watch movement is driven by an oscillating weight mechanism having an axis of rotation, mounted on a drive arbour for automatic winding of a spring or for driving a generator, the mechanism comprising:

(a) a primary oscillating weight secured to the drive arbour; and (b) at least one secondary oscillating weight that is mobile relative to the primary weight to give an initial impulse to the oscillating weight mechanism;

wherein the secondary weight is formed by a part exterior to the primary weight and is able to travel along a path concentric to the axis of rotation of the oscillating weight mechanism and between two stop members attached to a guide means, wherein the guide means is located on a periphery of the primary weight and is attached thereto, and wherein the primary weight is made in two parts formed on the one hand by a ring for securing to the drive arbour extended radially by two arms, and on the other hand by a felloe secured to the ends of the arms after the secondary weight has been assembled on the felloe, made in as single part, or pre-assembled prior to mounting, so as to slide on the felloe.

14. The oscillating weight mechanism according to claim 13, wherein the primary weight and the secondary weight have substantially the same weight.

15. A wristwatch whose electrical or mechanical power source for the watch movement is driven by an oscillating weight mechanism having an axis of rotation, mounted on a drive arbour for automatic winding of a spring or for driving a generator, the mechanism comprising:

(a) a primary oscillating weight secured to the drive arbour; and (b) at least one secondary oscillating weight that is mobile relative to the primary weight to give an initial impulse to the oscillating weight mechanism;

wherein the secondary weight is formed by a part exterior to the primary weight and is able to travel along a path concentric to the axis of rotation of the oscillating weight mechanism and between two stop members attached to a guide means, wherein the guide means is located on a periphery of the primary weight and is attached thereto, and wherein the primary weight the shape of a circular sector provided with a slot at the periphery thereof to form the guide means for the secondary weight made in two parts assembled on either side of the primary weight, by screws passing through the slot.

16. The oscillating weight mechanism according to claim 15, wherein the primary weight and the secondary weight have substantially the same weight.

17. A wristwatch whose electrical or mechanical power source for the watch movement is driven by an oscillating weight mechanism having an axis of rotation, mounted on a drive arbour for automatic winding of a spring or for driving a generator, the mechanism comprising:

(a) a primary oscillating weight secured to the drive arbour; and (b) at least one secondary oscillating weight that is mobile relative to the primary weight to give an initial impulse to the oscillating weight mechanism;

wherein the secondary weight is formed by a part exterior to the primary weight and is able to travel along a path concentric to the axis of rotation of the oscillating weight mechanism and between two stop members attached to a guide means, wherein the guide means is located on a periphery of the primary weight and is attached thereto, and wherein the guide means for the secondary weight are formed by a recess formed in the thickness of the periphery of the primary weight by cooperation of complementary male and female profiles, and wherein the guide means includes a stop member at each end, at least one stop member being removably mounted by means of a screw to allow the secondary weight to engage in the recess of the primary weight.

18. The oscillating weight mechanism according to claim 17, wherein the primary weight and the secondary weight have substantially the same weight.

19. A wristwatch whose electrical or mechanical power source for the watch movement is driven by an oscillating weight mechanism having an axis of rotation, mounted on a drive arbour for automatic winding of a spring or for driving a generator, the mechanism comprising:

(a) a primary oscillating weight secured to the drive arbour; and (b) at least one secondary oscillating weight that is mobile relative to the primary weight to give an initial impulse to the oscillating weight mechanism;

wherein the secondary weight is formed by a part exterior to the primary weight and is able to travel along a path concentric to the axis of rotation of the oscillating weight mechanism and between two stop members attached to a guide means, wherein the guide means is located on a periphery of the primary weight and is attached thereto, and wherein the primary weight is made up of an armature formed by a securing ring on the drive arbour, extended radially by an arm joining a median part of a felloe whose two parts form guide means for two secondary weights, a stop member being secured to each end of the felloe after the secondary weights have been assembled.

20. The oscillating weight mechanism according to claim 19, wherein the primary weight and the secondary weight have substantially the same weight.

* * * * *